United States Patent [19]

Zaucha

[11] 4,109,557

[45] Aug. 29, 1978

[54] GAS RIFLE

[76] Inventor: Charles D. Zaucha, 7137 Janey St., Shreveport, La. 71108

[21] Appl. No.: 785,101

[22] Filed: Apr. 6, 1977

[51] Int. Cl.[2] ..... F41F 1/04

[52] U.S. Cl. ..... 89/7; 42/29; 42/84

[58] Field of Search ..... 89/7, 33 MC; 42/28, 42/29, 35, 84

[56] References Cited

U.S. PATENT DOCUMENTS

| | | | |
|---|---|---|---|
| 378,525 | 2/1888 | Savage | 42/29 |
| 445,880 | 2/1889 | Warnant-Creon | 42/29 |
| 645,932 | 3/1900 | Beck et al. | 89/7 UX |
| 1,343,456 | 6/1920 | Jones | 89/7 |
| 1,383,111 | 6/1921 | Hall et al. | 89/7 |
| 1,596,057 | 8/1926 | Mallory | 89/7 |
| 2,088,503 | 7/1937 | Broussard | 89/7 |
| 3,208,181 | 9/1965 | Calhoun et al. | 42/84 |
| 3,255,669 | 6/1966 | Olofsson | 89/7 |
| 3,576,471 | 4/1971 | Schumacher | 42/84 X |
| 3,728,937 | 4/1973 | Nelson et al. | 89/7 |

*Primary Examiner*—David H. Brown

*Attorney, Agent, or Firm*—John M. Harrison

[57] ABSTRACT

A gas rifle which utilizes at least one combustible gas to drive the bullet and which includes a barrel and an associated combustion chamber with two gas storage containers and valve means for feeding gas at a controlled rate from gas supply cylinders into the combustion chamber. The rifle is provided with a pivoting breechblock and a piezoelectric crystal firing mechanism which ignites the gas or gaseous mixture in the combustion chamber by means of an electric spark upon pressing the trigger. Bullets may be fed into the breechblock in manual, semi-automatic or automatic mode of operation by a bullet feed linkage system in cooperation with a clip. A suitable recoil means can be utilized to permit semi-automatic and automatic modes of operation.

9 Claims, 16 Drawing Figures

GAS RIFLE

FIELD OF THE INVENTION

This invention relates to gas fired rifles, and more particularly, to a rifle which carries a supply of an ignitable gas and oxygen, and is equipped with a piezoelectric ignition means and a spark plug for effecting spark ignition of the gas-oxygen mixture. The rifle can be designed for both automatic and semi-automatic operation by providing a suitable recoil mechanism, and is capable of firing a large number of projectiles on a single charge of stored gas and oxygen. A chambered bullet is also capable of being removed without the necessity of firing the rifle, and a positive loading linkage operates in cooperation with a pivoting breechblock to effect rapid loading and firing of the rifle.

DESCRIPTION OF THE PRIOR ART

Gas guns have long been known in the prior art. One of the first of such guns is described in U.S. Pat. No. 1,164,876 to D. Sayler, which gun is characterized by a barrel fitted to a gas chamber capable of receiving a combustible gas by means of a valve and plunger combination. The gas is ignited by a spark plug mounted in the stock of the weapon, and the expansion of the burning gas forces the bullet out of the barrel.

An earlier variation on the gas operated theme is found in U.S. Pat. No. 715,648 to Michael Beck et al, which discloses a rifle having an air storage tank and a gasoline storage container with a valve and carburator combination for feeding an appropriate air-gas mixture into the recoil plunger-operated explosion chamber. The rifle includes a bullet storage magazine which operates to feed spherical bullets into the barrel. Ignition of the explosive gasoline-air mixture is effected by a battery activated sparking device.

Many of the prior art gas operated rifles are characterized by a high degree of mechanical complexity which results in high maintenance and low reliability. These rifles are also frequently characterized by difficulty in extracting a bullet from the chamber mechanism or breech under circumstances where it is desired to remove the projectile without firing the rifle. Other problems have been manifested in the positioning of gas storage tubes and in the reliability of the mechanism for supplying precise quantities of the propellant gas or gases from the storage container or containers to the combustion chamber. Still further problems have been realized in providing a reliable gas ignition device which permits the rifle to be fired precisely when desired.

Accordingly, an object of this invention is to provide an improved gas rifle which is light in weight, compact, highly reliable, easy to maintain and which includes a self-contained supply of an ignitable gas and oxygen, and a reliable ignition system.

Another object of the invention is to provide a gas rifle which is relatively cheap to operate, requires little internal cleaning, and which is further characterized by no external moving parts, and minimum misfiring and jamming.

Yet another object of the invention is to provide a new and improved gas rifle which includes a simple mechanism for removing projectiles from the rifle chamber or breech without the necessity of firing the rifle.

A still further object of the invention is to provide a gas rifle which utilizes a combustion gas and oxygen stored in separate containers in the rifle stock, which gases are metered into the combustion chamber in precise quantities and fired by operation of a piezoelectric crystal firing means immediately upon pressing the trigger.

Yet another object of the invention is to provide a new and improved gas rifle, the projectiles of which require no casing, and which rifle is fired by detonating a mixture of a combustible gas and oxygen contained in separate storage bottles or cylinders and metered into the combustion chamber in controlled quantities and fired by a piezoelectric and spark plug ignition system.

A still further object of the invention is to provide a gas rifle fitted with a pivoting breechblock and a bullet loading and extracting linkage system which permits rapid and positive manual loading, and, in cooperation with a suitable recoil means, semi-automatic or automatic loading of the rifle, and easy extraction of the bullet without the necessity of firing the rifle.

SUMMARY OF THE INVENTION

These and other objects of the invention are provided in a gas rifle which includes a firing or combustion chamber and barrel; a supply of combustible gas and oxygen, which when mixed in the combustion chamber are ignited by a piezoelectric ignition system; a mechanical linkage system and pivoting breechblock for manually loading the projectiles or bullets and selectively removing the bullets from the breechblock without the necessity of firing the rifle; and a trigger mechanism in cooperation with the piezoelectric ignition system for positive, reliable firing of the rifle.

BRIEF DESCRIPTION OF THE DRAWINGS

The invention will be better understood in view of the following description presented with reference to the accompanying drawings in which the gun stock, cocking grip and trigger mount or frame are not illustrated.

DESCRIPTION OF THE PREFERRED EMBODIMENTS

Figure 2:
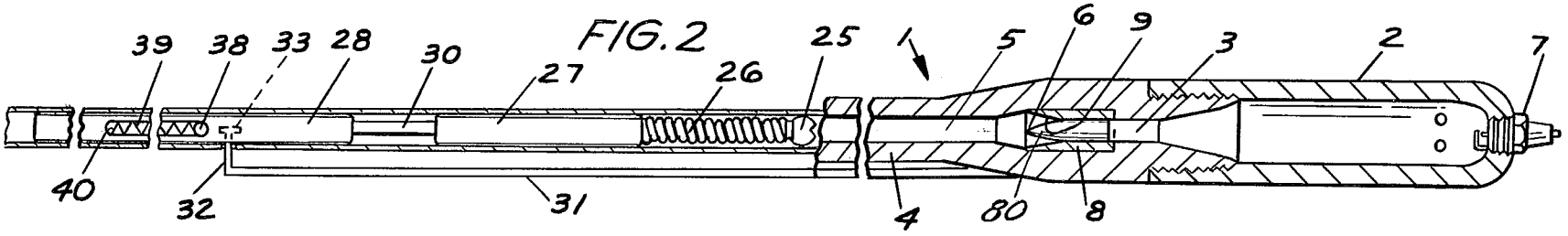
FIG. 2 is a top, sectional view of the gas rifle illustrated in FIG. 1, taken along lines 2—2 in FIG. 1.
Figure 1:
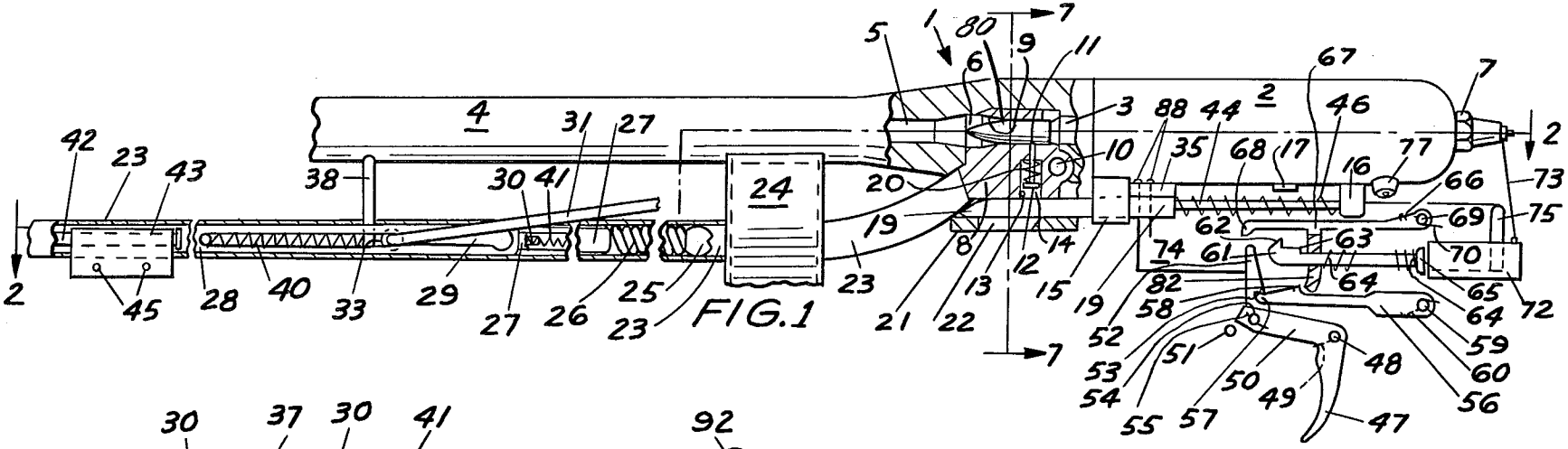
FIG. 1 of the drawing is a side view, partially in section, of the gas rifle of this invention.
Figure 5:
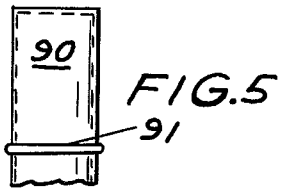
FIG. 5 is a side view of the clip illustrated in FIG. 4.
Figure 4:
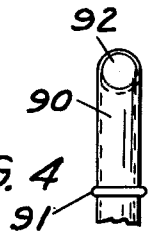
FIG. 4 is an end view of a typical clip for use with the rifle.

Referring now to FIGS. 1 and 2 of the drawing, the gas rifle of this invention is generally illustrated by reference numeral 1, and includes combustion chamber 2, barrel 4, a spark plug 7 for igniting a combustible gas and oxygen mixture, and pivoting breechblock 8. It will be appreciated from a consideration of FIG. 1 that breechblock 8 is pivotally mounted to barrel 4 by means of breechblock pivot pin 10. When pivoted into firing position as illustrated, breechblock 8 is positioned to effect registration of breechblock bore 9 with barrel bore 5 and barrel chamber 6. Combustion chamber 2 also communicates with breechblock bore 9 by means of combustion chamber neck 3. When breechblock 8 is pivoted downwardly under the influence of a suitable biasing means such as a spring (not illustrated), breechblock bore 9 is caused to register with bullet feed tube 23 to permit loading of a projectile or bullet 80 in breechblock bore 9 from a clip 90, more particularly illustrated in FIGS. 4 and 5 of the drawings. Clip 90 is spring loaded in conventional manner and fits inside clip retainer 24, with bullet feed aperture 92 in registration with bullet feed tube 23 to permit the bullets 80 contained in clip 90 to feed successively through bullet feed tube 23 and into breechblock bore 9 as the rifle is fired. Clip flange 91 on clip 90 enables precise alignment of bullet feed aperture 92 with bullet feed tube 23.

Referring now to FIGS. 1 and 7–9 of the drawings, when a bullet or 80 is loaded into breechblock bore 9 of breechblock 8, the tip of bullet retainer 11, positioned in bullet retainer aperture 14 provided in breechblock 8, extends into breechblock bore 9 and contacts the bullet 80 to secure it prior to firing of gas rifle 1. Bullet retainer 11 is constrained to remain inside bullet retainer aperture 14 by the provision of bullet retainer pin 13 and bullet retainer flange 12, as illustrated. Bullet retainer 11 is biased downwardly in bullet retainer aperture 14 by bullet retainer spring 20, for reasons hereinafter set forth.

Figure 3:
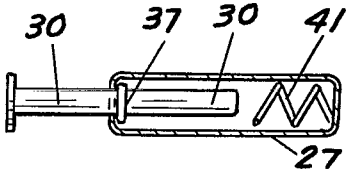
FIG. 3 is a side view, partially in section, of the bullet delay linkage apparatus of the gas rifle of this invention.

As further illustrated in FIG. 1 of the drawings, breechblock 8 is permitted to pivot downwardly on breechblock pivot pin 10 by slidable rearward displacement of rear connector leg platform 19 against the bias of platform rod spring 46, which is positioned on platform rod 44, located between rear connector leg platform 19 and platform rod support 16. The rearward travel of rear connector leg platform 19 is limited by rear connector leg stop 17, mounted on the underside of combustion chamber 2, and platform cap 15 is secured to combustion chamber 2 and serves to slidably receive and brace rear connector leg platform 19. Breechblock 8 pivots into breechblock support slot 22 of breechblock support 21 when rear connector leg platform 19 is displaced to permit loading or unloading of a bullet 80 in breechblock bore 9 of breechblock 8. Bullet feed tube 23 communicates with breechblock bore 9 at one end thereof and extends to one side of clip retainer 24 where it registers with bullet feed apertures 92 of clip 90, as heretofore described. Bullet feed tube 23 continues on the opposite side of clip retainer 24 in registration with bullet feed aperture 92 of clip 90 and in essentially parallel relationship to barrel 4. This portion of bullet feed tube 23 contains bullet pick-up 25, which is designed to engage a bullet 80 located in clip 90 and force it through bullet feed aperture 92 in clip 90 and through bullet feed tube 23 into breechblock bore 9. Bullet pick-up 25 is carried by spring tubing 26, which is designed to bend and conform to the shape of bullet feed tube 23 as it approaches breechblock bore 9. Bullet delay linkage 27 is attached to spring tubing 26 in tandem relationship inside bullet feed tube 23 as illustrated, and contains bullet delay linkage plunger 30, fitted with plunger stop 37, and biased in concentric relationship inside bullet delay linkage 27 by plunger spring 41, as more particularly illustrated in FIG. 3 of the drawing. Also mounted inside bullet feed tube 23 immediately behind and in contact with bullet delay linkage 27, is bullet delay cylinder 28, which is fitted with connector slot 29 on one side thereof, and bullet delay shaft pin slot 39 on the top thereof and 90 degrees disposed from connector slot 29, as illustrated in FIG. 2 of the drawings. One end of bullet delay shaft pin 38 is attached to barrel 4 and extends downwardly from the point of attachment, with the opposite end extending through bullet feed tube 23 and into bullet delay cylinder 28, as illustrated. Bullet delay shaft spring 40 is positioned inside bullet delay cylinder 28 between bullet delay shaft pin 38 and the closed forward end of bullet delay cylinder 28. Manual load bracket 43 is mounted on manual load shaft 42 at the extreme forward end of bullet feed tube 23, with the rear end of manual load shaft 42 in contact with the closed forward end of bullet delay cylinder 28, as illustrated. Manual load bracket 43 is designed to carry a conventional cocking grip (not illustrated) by means of bolts or screws which mate with manual load bracket apertures 45.

Figures 6, 7, 8, 9, 10, 11, 12, 13, 14, 15, 16:
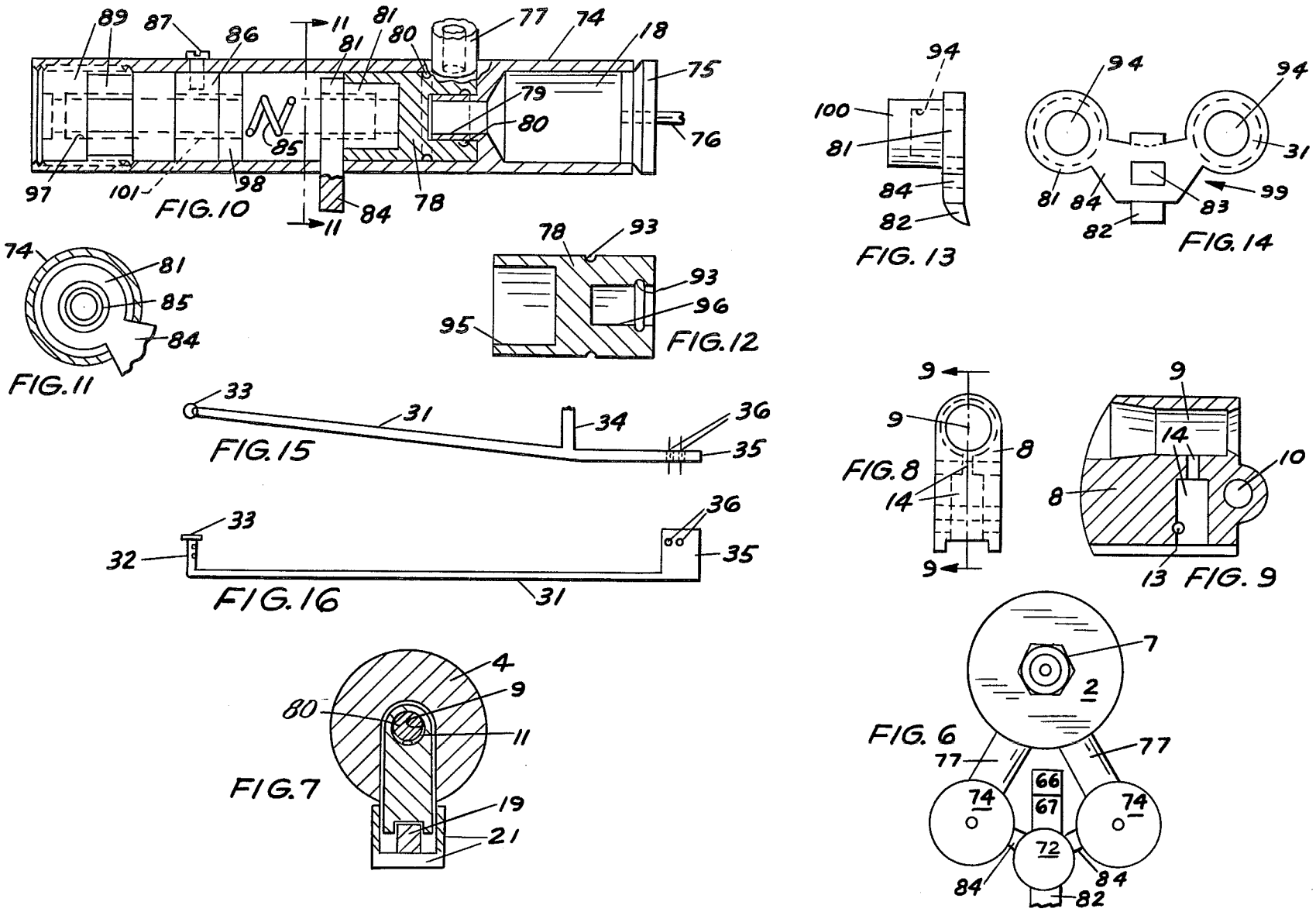
FIG. 6 is a rear elevation of the gas rifle illustrated in FIGS. 1 and 2.
FIG. 7 is a front sectional view of the pivoting breechblock, of the rifle, taken along lines 7—7 in FIG. 1.
FIG. 8 is a front elevation of the action illustrated in FIG. 7.
FIG. 9 is a side sectional view of the breechblock, taken along lines 9—9 in FIG. 8.
FIG. 10 is a side sectional view of one of the gas storage tubes illustrated in FIG. 6 of the drawing.
FIG. 11 is a sectional end view of the gas storage tube taken along line 11—11 in FIG. 10 and showing a complete cross-section thereof.
FIG. 12 is a side sectional view of the piston illustrated in the interior of the gas storage tube shown in FIG. 10.
FIG. 13 is a side view of the piston rider, bracket and trigger assembly, a portion of which is positioned in the interior of the gas storage tubes and the exterior portion of which communicates with the trigger means.
FIG. 14 is a front elevation of the piston rider, bracket and trigger assembly illustrated in FIG. 13.
FIG. 15 is a side view of the connector used to extract a bullet from within the action and initially load a bullet in the rifle.
FIG. 16 is a top view of the connector illustrated in FIG. 15.

Referring now to FIGS. 1, 2, 15 and 16 of the drawings, connector 31, more particularly illustrated in FIGS. 15 and 16 of the drawings, is fitted with forward connector leg 32 and forward connector leg flange 33 at the front end thereof, and with rear connector leg 35 and rear connector leg apertures 36 on the opposite end. Connector grip 34 is positioned near rear connector leg 35 in essentially perpendicular relationship to connector 31, as illustrated in FIG. 15. Referring specifically now to FIGS. 1 and 2 of the drawings, forward connector leg 32 communicates in slidable relationship with connector slot 29 of bullet delay cylinder 28, and is prevented from exiting connector slot 29 by forward connector leg flange 33, as illustrated. Furthermore, rear connector leg 35 is attached to rear connector leg platform 19 by rivets 88 as illustrated in FIG. 1. This configuration of connector 31 facilitates the positioning of connector grip 34 downwardly in position to be grasped and manipulated to remove a projectile from breechblock 8, as hereinafter described.

Referring again to FIG. 1 of the drawing, the trigger mechanism of gas rifle 1 is illustrated, with trigger 47 pivotally carried by trigger pivot pin 48, which is mounted on a trigger frame (not illustrated), and biased against the trigger pull by trigger spring 49. Trigger stop pin 51 is also mounted on the trigger frame and serves to limit the travel of trigger 47 and the attached release lever retainer 52. Trigger arm 50 extends from trigger 47 and is pivotally attached to release lever retainer 52 by release lever retainer pivot pin 54. Release lever retainer 52 is fitted with release lever retainer hook 53, and is biased rearwardly with respect to trigger arm 50 by released lever retainer spring 55. Release lever retainer hook 53 is in releasable engagement with release lever tip 57 of release lever 56, the latter of which is pivoted on release lever pivot pin 59, mounted on the trigger frame, and is biased upwardly against release lever retainer hook 53 by means of release lever spring 60. Release lever 56 is also fitted with a release lever hook 58 on the top edge thereof, as illustrated. Hammer 61 is carried by piezoelectric crystal 72 and extends essentially parallel to combustion chamber 2. An electric conduit or wire 73 communicates between piezoelectric crystal 72 and spark plug 7 to facilitate firing of the combustible gas or gases at the proper time. Hammer 61 also cooperates with piston rider trigger 82 through piston rider trigger aperture 83 (illustrated in FIG. 14), and is fitted with first hammer retainer hook 62 and second hammer retainer hook 63, as illustrated. A hammer flange 65 is fitted to hammer 61 immediately adjacent piezoelectric crystal 72, and a hammer return spring 64 is positioned on hammer 61 between piston rider trigger 82 and hammer flange 65. Similarly, hammer catch 66 is fitted with hammer catch tooth 68 and hammer catch leg 67, the latter of which is also in engagement with the bevelled top of piston rider trigger 82. Hammer catch 66 is pivotally secured to the trigger frame of gas rifle 1 by means of hammer catch pivot pin 69, and is biased downwardly against piston rider trigger 82 by hammer catch spring 70.

Referring now to FIGS. 6 and 10–14 of the drawings, a pair of gas storage tubes 74 are illustrated in position beneath and to either side of combustion chamber 2 and attached to combustion chamber 2 by gas feed tubes 77. As further illustrated in FIG. 10, gas storage tubes 74 each include a gas storage chamber 18 and a piston seat 79 in the interior of gas storage tubes 74, the latter of which is adapted to slidably receive a piston 78, more particularly illustrated in FIG. 12. Each piston 78 is provided with a piston seal cavity 96 for mating with each piston seat 79. Each piston 78 is slidably sealed inside gas storage tubes 74, respectively, by means of a pair of O rings 80, fitted in O ring grooves 93 provided in each piston 78, as illustrated in FIGS. 10 and 12. Gas feed tubes 77 communicate with gas storage tubes 74 at the point where each piston 78 cooperates with each piston seat 79, respectively, as particularly illustrated in FIG. 10. It will be appreciated that each piston 78 is slidably mounted in one of gas storage tubes 74 against the bias of piston return spring 85, mounted as illustrated in FIG. 10, and as hereinafter described. Piston rider 99, more particularly illustrated in FIGS. 13 and 14 of the drawings, is fitted with a pair of piston rider rings 81, each having a rearwardly extending projection 100, which is designed to mate with the piston cavity 95 in each piston 78, respectively. One end of piston return spring 85 is positioned inside piston rider cavity 94, and the other end inside adjusting plug cavity 97 of adjusting plug 89, to bias piston rider rings 81 and each piston 78 against each piston seat 79, respectively. Piston stops 86, carrying piston rider ring bumpers 98 and fitted with three set screws 87 disposed about 120 degrees apart are secured inside gas storage tubes 74 between each adjusting plug 89 and piston rider rings 81 to provide a cushioning of contact between each piston rider 81 and piston stops 86, respectively, as hereinafter described. Piston stops 86 and piston rider ring bumpers 98 are provided with an interior aperture 101 to accommodate piston return spring 85. It will be appreciated that each of piston rider rings 81 is mounted in a separate one of gas storage tubes 74 as illustrated in FIGS. 10 and 11 of the drawings, and are attached to piston rider ring bracket 84, with piston rider trigger 82 disposed therebetween and fitted with piston rider trigger aperture 83, through which hammer 61 extends, as heretofore described. As further illustrated in FIG. 11 of the drawing, piston rider ring bracket 84 extends through a slot in the wall of each one of gas storage tubes 74, which slot extends between each of the piston rider rings 81 and piston rider ring bumpers 98. As heretofore described, one end of each of the gas storage tubes 74 is fitted with an adjusting plug 89, which is threadably secured in one end of gas storage tubes 74, and which can be manipulated to adjust the tension on piston return spring 85, and the pressure on piston rider rings 81 and piston 78. The opposite end of each of gas storage tubes 74 is capped by gas supply plug 75, which is fitted with gas supply tubing 76, as illustrated. Gas supply tubing 76 communicate with a pair of gas supply cylinders (not illustrated) of suitable size to be located in the butt of the rifle and to contain enough gas for multiple firings. Gas supply tubing 76 is of sufficiently small inside diameter to prevent immediate repressuring of gas storage chamber 18 to gas supply cylinder pressure after each firing sequence. The gas supply cylinders are designed to be easily refilled in conventional manner when exhausted. A pair of valves and conventional pressure regulators (not illustrated) are also provided in gas supply tubing 76 between the supply cylinders and gas storage tubes 74 to initiate gas flow and regulate the gas pressure to gas storage tubes 74, respectively.

In operation, when it is desired to initially load gas rifle 1, and referring first to FIGS. 1–5, the gas supply valves are opened, a loaded clip 90 is fitted into clip retainer 24, and manual load bracket 43 is initially pulled rearwardly by grasping the attached cocking grip (not illustrated). This action causes manual load shaft 42 to move rearwardly against bullet delay cylinder 28, which in turn also moves backward against the bias of bullet delay shaft spring 40. This movement of bullet delay cylinder 28 forces bullet delay linkage plunger 30 against plunger spring 41 in bullet delay linkage 27, and in turn causes spring tubing 26 and bullet pick-up 25 to move rearwardly through bullet feed tube 23 toward bullet feed aperture 92 of clip 90. As manual load bracket 43 is extended rearwardly, bullet 80 pick-up 25 contacts the top bullet in clip 90 and displaces it through bullet feed aperture 92 into bullet feed tube 23. Further extension of manual load bracket 43 effects engagement of forward connector leg 32 of connector 31 with the forward end of connector slot 29, and displacement of connector 31 rearwardly to cause rear connector leg platform 19 to also be displaced rearwardly against the bias of platform rod spring 46. This action permits breechblock 8 to pivot downwardly into breechblock support slot 22, responding to a suitable bias (not illustrated), into position permitting registration of breechblock bore 9 and bullet 80 feed tube 23. The bullet displaced by bullet pick-up 25 is then pushed into breechblock bore 9. Pressure on the cocking grip is then released to permit the compressed platform rod spring 46, plunger spring 41 and bullet delay shaft spring 40 to return bullet pick-up 25, spring tubing 26, bullet delay linkage 27, bullet delay cylinder 28, manual load bracket 43, manual load shaft 42, and rear connector leg platform 19 to their original positions as illustrated in FIG. 1. Slidable movement of rear connector leg platform 19 to its original position beneath breechblock 8 causes breechblock 8 to pivot back into its original position as illustrated. This action also effects contact between the bottom end of bullet retainer 11 and rear connector leg platform 19 to force bullet retainer 11 upwardly against the bias of bullet retainer spring 20 and the top end of bullet 80 retainer 11 against the bullet to secure it firmly inside breechblock bore 9, as previously described. The gas rifle is then ready to be fired, and the above procedure is repeated for manual reloading after firing. Semi-automatic and automatic operation can be effected by application of a suitable recoil means, as hereinafter described.

Referring again to FIGS. 1 and 10 of the drawings, to fire gas rifle 1, trigger 47 is pressed, which causes trigger arm 50 to pivot downwardly on trigger pivot pin 48, and further causes release lever retainer 52 and release lever 56 to also pivot downwardly against the bias of release lever spring 60 and trigger spring 49. When release lever 56 is forced downwardly, piston rider trigger 82 is disengaged from release lever hook 58 of release lever 56, and gases from the gas supply cylinders which have pressured gas storage chamber 18 force piston 78 and piston rider rings 81 away from piston seat 79 against the bias of piston return spring 85. Piston rider rings 81 are driven against piston rider ring bumper 98 when piston 78 is fully extended by the gas pressure, as the gas forces piston 78 forward. As piston seal cavity 96 and the rear one of O rings 80 moves away from piston seat 79, the pressured gas in each gas storage chamber 18 of gas storage tubes 74 moves through gas feed tubes 77 into combustion chamber 2 at a rate determined by the inside diameter of gas feed tubes 77 and the gas pressure. As the pressure of the gases in each gas storage chamber 18 is momentarily reduced by expansion into combustion chamber 2, piston return spring 85 forces piston rider rings 81, piston rider trigger 82, and piston 78 back into their original positions, as illustrated, thereby again sealing piston seal cavity on piston seat 79 and preventing further flow of gases into combustion chamber 2. As piston rider 99 and piston rider trigger 82 initially move forward in the first expansion of the gases in gas storage chambers 18, hammer catch 66 pivots downwardly on hammer catch pivot pin 69 due to the bias of hammer catch spring 70. Hammer 61 is also forced away from piezoelectric crystal 72 as piston rider trigger 82 engages second retainer hook 63 of hammer 61. In manual and semi-automatic mode, the projecting end of hammer 61 engages release lever retainer 52 and pivotally disengages release lever hook 53 from contact with release lever tip 57 of release lever 56 against the bias of release lever spring 60 and release lever retainer spring 55. This action permits release lever 56 to pivot upwardly with the bias of release lever spring 60 in position to receive piston rider trigger 82 when it returns to its original position under the influence of piston return spring 85. As piston rider 99 and piston rider trigger 82 continue to move forward, first retainer hook 62 of hammer 61 engages hammer catch tooth 68 of hammer catch 66, and secures hammer 61 in extended position. Piston rider trigger 82 then begins to move back toward its original position against the bias of hammer return spring 64, as illustrated in FIGS. 1 and 10. Further movement of piston rider 99 and piston rider trigger 82 back toward their original positions causes hammer catch 66 to pivot upwardly on hammer catch pivot pin 69 against the bias of hammer catch spring 70 as the top edge of piston rider trigger 82 slidably engages hammer catch leg 67 of hammer catch 66. This action disengages hammer catch tooth 68 from first hammer retainer hook 62 of hammer 61, and permits hammer 61 to sharply contact piezoelectric crystal 72 under the bias of hammer return spring 64 to produce a voltage in electric conduit 73 and spark plug 7 for firing the gases in combustion chamber 2.

As described above, and referring again to FIG. 1 of the drawings, firing of the gas mixture is achieved by piezoelectricity (pressure electricity). The electric spark is generated by applying pressure by means of hammer 61 to a piezoelectrically energized ceramic (piezoelectric crystal 72) which causes the ceramic to create a high voltage spark. Typical of such spark producing devices, which are commercially available, is a device bearing the trademark "Gasliter", and marketed by Channel Products Incorporated, of Chagrin Falls, Ohio.

As heretofore noted, while any number of explosive gases can be utilized in the gas rifle of this invention, it is preferred to use petroleum gases in order to form a combustible mixture of desired composition. For example, oxygen and petroleum gases such as propane can be utilized in the invention, as well as other combustible combinations well known to those skilled in the art.

Referring again to FIGS. 1 and 10 of the drawings, it will be appreciated that the reciprocating movement of piston 78 and piston rider 99 responsive to gas pressure and the spring bias of piston return spring 85 in each of gas storage tubes 74 is effected by the internal size of gas supply tubing 76. When piston 78 and piston rider rings 81 are fully extended by gas pressure and the gases are flowing from gas storage chamber 18 through gas feed tubes 77 into combustion chamber 2, the pressure in each gas storage chamber 18 is reduced to a point where each piston return spring 85 is able to return piston 78 and piston rider 99 to their original positions as illustrated in FIG. 10. This is made possible by selecting gas supply tubing 76 of sufficient size, preferably about 1/32 of an inch, that the pressure in each gas storage chamber 18 will not immediately rise across the valve and pressure regulator to that of the gas supply cylinders. Additional adjustment of this parameter is made possible by adjusting plug 89, which can be manipulated to adjust the tension on piston return spring 85 as heretofore described.

If it is desired to unload gas rifle 1 without firing the rifle, and referring again to FIGS. 1, 15 and 16 of the drawings, clip 90 is first removed, and connector grip 34 of connector 31 is initially grasped and pulled rearwardly until forward connector leg 32 reaches the end of connector slot 29. This action causes rear connector leg platform 19 to move rearwardly against the bias of platform rod spring 46, as in the loading operation previously described, but independently of any movement of bullet pick-up 25, spring tubing 26, bullet delay linkage 27, bullet delay cylinder 28, manual load shaft 42 and manual load bracket 43, because of connector slot 29. Accordingly, breechblock 8 is permitted to pivot and allow the bullet 80 to exit breechblock bore 9, into bullet feed tube 23 and out of clip retainer 24.

As heretofore noted, the gun stock, cocking grip, trigger mount or frame and other external features of the gas rifle of this invention have not been described with particularity or provided in the drawing, since it will be appreciated by those skilled in the art that a conventional stock, cocking grip, trigger mount and other such parts can be provided as necessary.

Accordingly, having described my invention with the particularity set forth above, what is claimed is:

1. A gas rifle comprising:
(a) a barrel having a barrel bore;
(b) a combustion chamber communicating with said barrel;
(c) a breechblock pivotally mounted in said barrel and having a breechblock bore registering with said barrel bore when said breechblock is in firing configuration;
(d) loading means for supplying a projectile or bullet in said breechblock bore when said breechblock is pivoted into loading configuration;
(e) gas supply means for supplying a combustible gas and oxygen to said combustion chamber; and
(f) ignition means for supplying a spark in said combustion chamber to ignite said gas and said oxygen and propel said bullet from said barrel.

2. The gas rifle of claim 1 wherein said loading means further comprises:
(a) a hollow clip retainer fastened to and downwardly extending from said barrel;
(b) a clip for insertion in said clip retainer and having a bullet feet aperture and containing at least one bullet;
(c) a bullet feed tube mounted on said barrel and in registration with said bullet feed aperture of said clip and in further registration with said breechblock bore when said breechblock is pivoted into said loading configuration;
(d) bullet feed means slidably disposed in said bullet feed tube for forcing said bullet from said clip through said bullet feed aperture and said bullet feed tube into said breechblock bore when said breechblock is pivoted into said loading configuration;
(e) platform means slidably mounted beneath said breechblock for rearward displacement when said bullet feed means is activated to permit said breechblock to pivot into said loading configuration; and
(f) connector means having one end attached to said bullet feed means and the other end connected to said platform means for effecting rearward displacement of said platform means responsive to manipulation of said bullet feed means.

3. The gas rifle of claim 1 wherein said gas supply means further comprises:
(a) a pair of gas storage tubes, each having a piston and a piston rider ring slidably biased therein and gas supply tubing communicating therewith; and
(b) a gas feed tube carried by each of said gas storage tubes and communicating with said combustion chamber for introducing said combustible gas and said oxygen into said combustion chamber from said gas storage tubes responsive to slidable displacement of said piston and said piston rider ring in said gas storage tubes.

4. The gas rifle of claim 1 wherein said ignition means further comprises:
(a) trigger means pivotally carried by said combustion chamber and activated by finger pressure;
(b) piezoelectric spark producing means cooperating with said trigger means and responsive to activation of said trigger means;
(c) a spark plug threadably provided in said combustion chamber; and
(d) an electric conduit communicating between said piezoelectric spark producing means and said spark plug for carrying an electrical current to permit detonation of said gas in said combustion chamber responsive to activation of said trigger means.

5. The gas rifle of claim 1 wherein said loading means further comprises:
(a) a hollow clip retainer fastened to and downwardly extending from said barrel;
(b) a clip for insertion in said clip retainer and having a bullet feed aperture and containing at least one projectile or bullet;
(c) a bullet feed tube mounted on said barrel and in registration with said bullet feed aperture of said clip and in further registration with said breechblock bore when said breechblock is pivoted into said loading configuration;
(d) bullet feed means slidably disposed inside said bullet feed tube, and including in tandem configuration, respectively, a bullet pick-up; spring tubing positioned behind and carrying said bullet pick-up; bullet delay linkage; bullet delay cylinder; manual load shaft; and a manual load bracket carried by said manual load shaft for effecting travel of said bullet pick-up, said spring tubing, said bullet delay linkage, said bullet delay cylinder and said manual load shaft in said bullet feed tube;
(e) platform means slidably mounted beneath said breechblock, including a platform cap mounted on said combustion chamber; a rear connector leg platform slidably carried by said platform cap; a platform rod having one end mounted on said rear connector leg platform; a platform rod support carried by said combustion chamber and receiving the opposite end of said platform rod; and a platform rod spring carried by said platform rod for biasing said rear connector leg platform in position beneath said breechblock; and
(f) a connector having one end in slotted cooperation with said bullet delay cylinder and the other end attached to said rear connector leg platform for rearward displacement of said rear connector leg platform against the bias of said platform rod spring when said manual load bracket is moved rearwardly.

6. The gas rifle of claim 1 wherein said gas supply means further comprises:
(a) a pair of gas storage tubes, each having a gas storage chamber and a piston, and a piston rider ring slidably disposed in said gas storage tubes opposite said gas storage chamber; a piston return spring positioned in each of said gas storage tubes adjacent said piston rider ring for biasing said piston rider ring and said piston in seated configuration to seal said gas storage chamber; and gas supply tubing communicating with said gas storage chamber; and
(b) a gas feed tube carried by each of said gas storage tubes and communicating between said gas storage chamber and said combustion chamber for introducing said combustible gas and said oxygen into said combustion chamber from said gas storage chamber, respectively, responsive to slidable displacement of said piston and said piston rider rings in said gas storage tubes against the bias of said piston ruturn spring.

7. The gas rifle of claim 1 wherein:

(a) said loading means further comprises:

a hollow clip retainer fastened to and downwardly extending from said barrel;

a clip for insertion in said clip retainer and having a bullet feed aperture and containing at least one projectile or bullet;

a bullet feed tube mounted on said barrel and in registration with said bullet feed aperture of said clip and in further registration with said breechblock bore when said breechblock is pivoted into said loading configuration;

bullet feed means slidably disposed inside said bullet feed tube, and including in tandem configuration, respectively, a bullet pick-up; spring tubing positioned behind and carrying said bullet pick-up; bullet delay linkage; bullet delay cylinder; manual load shaft; and a manual load bracket carried by said manual load shaft for effecting travel of said bullet pick-up, said spring tubing, said bullet delay linkage, said bullet delay cylinder and said manual load shaft in said bullet feed tube;

platform means slidably mounted beneath said breechblock, including a platform cap mounted on said combustion chamber; a rear connector leg platform slidably carried by said platform cap; a platform rod having one end mounted on said rear connector leg platform; a platform rod support carried by said combustion chamber and receiving the opposite end of said platform rod; and a platform rod spring carried by said platform rod for biasing said rear connector leg platform in position beneath said breechblock; and a connector having one end in slotted cooperation with said bullet delay cylinder and the other end attached to said rear connector leg platform for rearward displacement of said rear connector leg platform against the bias of said platform rod spring when said manual load bracket is moved rearwardly;

(b) said gas supply means further comprises:

a pair of gas storage tubes, each having a gas storage chamber and a piston, and a piston rider ring slidably disposed in said gas storage tubes opposite said gas storage chamber; a piston return spring positioned in each of said gas storage tubes adjacent said piston rider ring for biasing said piston rider ring and said piston in seated configuration to seal said gas storage chamber; and gas supply tubing communicating with said gas storage chamber and a gas feed tube carried by each of said gas storage tubes and communicating between said gas storage chamber and said combustion chamber for introducing said combustible gas and said oxygen into said combustion chamber from said gas storage chamber, respectively, responsive to slidable displacement of said piston and said piston rider rings in said gas storage tubes against the bias of said piston return spring; and (c) said ignition means further comprises:

a trigger pivotally carried by said combustion chamber;

an essentially horizontally disposed release lever biased upwardly in pivotal cooperation with said combustion chamber and having a release lever hook on the top thereof;

an essentially vertically disposed release lever retainer in pivotal attachment to said trigger and having a release lever retainer hook facing said release lever and in biased engagement with the end of said release lever;

a stop pin mounted on said combustion chamber forward of said trigger for limiting the travel of said trigger;

a hammer disposed in essentially horizontal relationship above said release lever and slidably carried by, and biased against said piezoelectric spark producing means, and having first and second retainer hooks configured on the top surface thereof;

a vertically disposed piston rider trigger carried by said piston rider ring and slidably disposed on said hammer, and in engagement with said release lever hook;

an essentially horizontally disposed, downwardly biased hammer catch positioned above said hammer and in pivotal cooperation with said combustion chamber and fitted with a hammer catch tooth on the projecting end thereof for engagement with said first retainer hook, and a downwardly extending hammer catch leg for engagement with the top of said piston rider trigger;

piezoelectric spark producing means cooperating with said hammer and responsive to activation of said trigger;

a spark plug threadably provided in said combustion chamber; and an electric conduit communicating between said piezoelectric spark producing means and said spark plug for carrying an electrical current to permit detonation of said gas in said combustion chamber responsive to activation of said trigger.

8. The gas rifle of claim 1 wherein:

(a) said loading means further comprises:

a hollow clip retainer fastened to and downwardly extending from said barrel;

a clip for insertion in said clip retainer and having a bullet feed aperture and containing at least one projectile or bullet;

a bullet feed tube mounted on said barrel and in registration with said bullet feed aperture of said clip and in further registration with said breechblock bore when said breechblock is pivoted into said loading configuration;

bullet feed means slidably disposed in said bullet feed tube for forcing said bullet from said clip through said bullet feed aperture and said bullet feed tube into said breechblock bore when said breechblock is pivoted into said loading configuration;

platform means slidably mounted beneath said breechblock for rearward displacement when said bullet feed means is activated to permit said breechblock to pivot into said loading configuration; and connector means having one end attached to said bullet feed means and the other end connected to said platform means for effecting rearward displacement of said platform means responsive to manipulation of said bullet feed means;

(b) said gas supply means further comprises:

a pair of gas storage tubes, each having a piston and a piston rider ring slidably biased therein and gas supply tubing communicating therewith; and a gas feed tube carried by each of said gas storage tubes and communicating with said combustion chamber for introducing said combustible gas and said oxygen into said combustion chamber from said gas storage tubes responsive to slidable displacement of said piston and said piston rider ring in said gas storage tubes; and (c) said ignition means further comprises:

trigger means pivotally carried by said combustion chamber and activated by finger pressure;

piezoelectric spark producing means cooperating with said trigger means and responsive to activation of said trigger means;

a spark plug threadably provided in said combustion chamber; and an electric conduit communicating between said piezoelectric spark producing means and said spark plug for carrying an electrical current to permit detonation of said gas in said combustion chamber responsive to activation of said trigger means.

9. The gas rifle of claim 8 wherein said trigger means further comprises:

(a) a trigger pivotally attached to said combustion chamber;

(b) an essentially horizontally disposed release lever biased upwardly in pivotal cooperation with said combustion chamber and having a release lever hook on the top thereof;

(c) an essentially vertically disposed release lever retainer in pivotal attachment to said trigger and having a release lever retainer hook facing said release lever and in biased engagement with the end of said release lever;

(d) a stop pin mounted on said trigger housing forward of said trigger for limiting the travel of said trigger;

(e) a hammer disposed in essentially horizontal relationship above said release lever and slidably carried by, and biased against said piezoelectric spark producing means, and having first and second retainer hooks configured on the top surface thereof;

(f) a vertically disposed piston rider trigger carried by said piston rider ring and slidably disposed on said hammer, and in engagement with said release lever hook; and (g) an essentially horizontally disposed, downwardly biased hammer catch positioned above said hammer and in pivotal cooperation with said combustion chamber, and fitted with a hammer catch tooth on the projecting end thereof for engagement with said first retainer hook, and a downwardly extending hammer catch leg for engagement with the top of said piston rider trigger.

* * * * *